US008724820B2

(12) United States Patent
Sako et al.

(10) Patent No.: US 8,724,820 B2
(45) Date of Patent: May 13, 2014

(54) METHOD OF REPRODUCING AUDIO SIGNALS AND PLAYBACK APPARATUS THEREFOR

(75) Inventors: Yoichiro Sako, Tokyo (JP); Toshiro Terauchi, Tokyo (JP); Masayoshi Miura, Chiba (JP); Susumu Yabe, Tokyo (JP); Kosei Yamashita, Kanagawa (JP)

(73) Assignee: Sony Corporation, Tokyo (JP)

( * ) Notice: Subject to any disclaimer, the term of this patent is extended or adjusted under 35 U.S.C. 154(b) by 1743 days.

(21) Appl. No.: 11/208,569

(22) Filed: Aug. 23, 2005

(65) Prior Publication Data

US 2006/0062411 A1 Mar. 23, 2006

(30) Foreign Application Priority Data

Sep. 17, 2004 (JP) ..... 2004-270873

(51) Int. Cl.
*H04R 5/00* (2006.01)

(52) U.S. Cl.
USPC ..... 381/17

(58) Field of Classification Search
CPC ..... H04S 2420/13
USPC ..... 381/17, 152; 700/94
See application file for complete search history.

(56) References Cited

U.S. PATENT DOCUMENTS 4,008,641 A * 2/1977 Takada et al. ..... 84/706
6,694,033 B1 2/2004 Rimell et al.
2003/0086580 A1* 5/2003 Hamamatsu ..... 381/119
2005/0175197 A1 8/2005 Melchior et al.
2005/0259828 A1* 11/2005 Van den Berghe ..... 381/23

FOREIGN PATENT DOCUMENTS

| | | |
|---|---|---|
| JP | 5-297866 | 11/1993 |
| JP | 11-231865 | 8/1999 |
| JP | 2002-51400 | 2/2002 |
| JP | 2002-505058 | 2/2002 |
| JP | 2002-191098 | 7/2002 |
| JP | 2006-507727 | 3/2006 |
| WO | WO 98/58523 | 12/1998 |
| WO | WO 2004/047485 A1 | 6/2004 |

OTHER PUBLICATIONS

Werner P.J. de Bruijn, Marinus M. Boone, "Subjective experiments on the effects of combining spatialized audio and 2D video projection in audio-visual systems", Audio Engineering Society, 112th convention, May 10-13, 2002, preprint 5582.*

Marinus M. Boone; "Acoustic rendering with wave field synthesis"; ACM SIGGRAPH and Eurographics Campfire: Acoustic Rendering for Virtual Environments; May 29, 2001; pp. 1-9; Snowbird, Utah, USA.*

Bernardini, Nicola; Vidolin, Alvise. Sound Motion and Space Parameters on a Stereo CD. Journal of New Music Research, Jun. 2002, vol. 31, Issue 2, pp. 171-175.*

J. Chowning, The Simulation of Moving Sound Sources, J. Audio Eng. Soc., vol. 19, No. 1, Jan. 1971, pp. 2-6.*

* cited by examiner

*Primary Examiner* — Duc Nguyen
*Assistant Examiner* — Kile Blair
(74) *Attorney, Agent, or Firm* — Oblon, Spivak, McClelland, Maier & Neustadt, L.L.P.

(57) ABSTRACT

A method of reproducing audio signals includes the steps of supplying a predetermined audio signal to a speaker array to synthesize surface wavefronts and forming a virtual sound source by the wavefront synthesis; and controlling the audio signal in order to change the position of the virtual sound source in the vicinity of the virtual sound source.

12 Claims, 9 Drawing Sheets

$$p(ri)=\int_s \left(p(rj)\frac{\partial Gij}{\partial n}+j\omega\rho un(rj)Gij\right)ds \quad \cdots(1)$$

WHERE $$Gij=\frac{\exp(-jk|ri-rj|)}{4\pi|ri-rj|}$$

METHOD OF REPRODUCING AUDIO SIGNALS AND PLAYBACK APPARATUS THEREFOR

CROSS REFERENCES TO RELATED APPLICATIONS

The present invention contains subject matter related to Japanese Patent Application JP 2004-270873 filed in the Japanese Patent Office on Sep. 17, 2004, the entire contents of which are incorporated herein by reference.

BACKGROUND OF THE INVENTION

1. Field of the Invention

The present invention relates to a method of reproducing audio signals and a playback apparatus therefor.

2. Description of the Related Art

In a 2-channel stereo, as shown in, for example, FIG. 10, a virtual sound source VSS is formed in a line that connects a speaker SPL of the left channel to a speaker SPR of the right channel. Sound is output from the virtual sound source VSS, and also, a sound image is localized at the position of the virtual sound source VSS. In this case, a listener can obtain the best effects when the listener is positioned at the apex of a regular triangle in which the straight line that connects between the speakers SPL and SPR is the base.

Furthermore, in a multi-channel stereo in which a sound field is formed by a large number of speakers, the original sound field can be reproduced more accurately.

The following is an exemplary document of the related art: PCT Japanese Translation Patent Publication No. 2002-505058

SUMMARY OF THE INVENTION

When a musical instrument is actually played, most musical instruments are supported with the performer's hands. Therefore, the position of the musical instrument during a performance, in particular, in accordance with melody and rhythm, fluctuates a little. Even in the case of a musical instrument that is fixed to a floor and that is played like a piano, sound produced from the musical instrument is reflected and diffracted by the performer. Also, since the performer move his/her body during a performance, the position of the musical instrument fluctuates in an equivalent manner. Furthermore, in the case of a song, a speech, and a conversation, the position and the orientation of the head and the face of the singer or the speaker, that is, the position of the mouth, which is the sound source, fluctuates during the speech.

When the virtual sound source VSS is formed by a stereo system, the position thereof is fixed to the line connecting between the two speakers SPL and SPR as described above. For this reason, when the performance and the speech are played back by the stereo system, this becomes unnatural and lacks a lively feeling and a sense of realism.

It is desirable to overcome such problems.

According to an embodiment of the present invention, there is provided a method of reproducing audio signals, the method including the steps of: supplying a predetermined audio signal to a speaker array to synthesize surface wavefronts and forming a virtual sound source by the wavefront synthesis; and controlling the audio signal in order to change the position of the virtual sound source in the vicinity of the virtual sound source.

According to the embodiment of the present invention, the position of the virtual sound source to be reproduced is made to fluctuate. Consequently, during the playback of music, it is possible to provide a sound field and a sound source that are natural, that have an abundant lively feeling and a rich sense of realism, and that are expansionary. Alternatively, in the case of voice, it is possible to produce reality by which breathing can be sensed.

Furthermore, the movement state of the sound source can also be simulated, and special deformation effects can also be created. In particular, when video such as animation, a game, or an SF movie exists, a more effective sound image processing can be performed.

DESCRIPTION OF THE PREFERRED EMBODIMENTS

This invention realizes a virtual sound source by using a wavefront synthesis technology, and also, solves the above-described problems by controlling the position of the virtual sound source. These will be described below in sequence.

(1) Reproduction of Sound Field

Figures 1, 2:
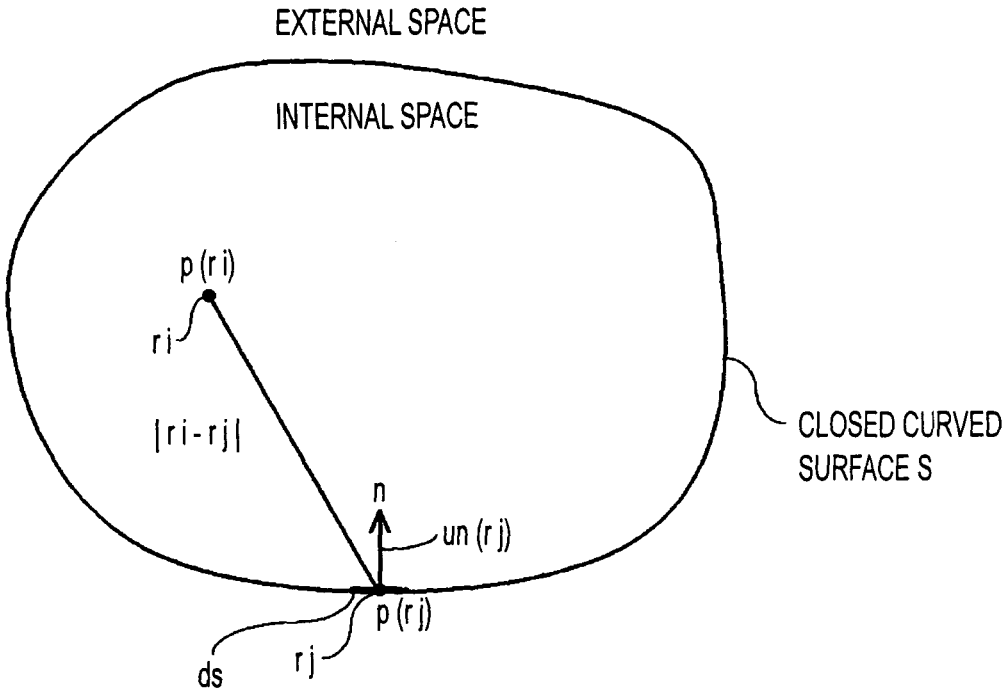
FIG. 1 shows a sound space for the purpose of illustrating an embodiment of the present invention.
FIG. 2 shows equations for the purpose of illustrating an embodiment of the present invention.

As shown in FIG. 1, a closed curved surface S in which a space of any desired shape is enclosed is assumed, and also, it is assumed that a sound source is not contained inside the closed curved surface S. Then, if the following are set with respect to the internal space and the external space of the closed curved surface S, the Kirchhoff's integration formula is expressed by equation (1) in FIG. 2:

p(ri): a sound pressure of a desired point ri in the internal space p(rj): a sound pressure of the desired point ri in the closed curved surface S ds: a very small area containing the point rj n: a normal line with respect to the very small area ds at the point rj un(rj): a particle speed in the direction of the normal line n at the point rj ω: an angular frequency of an audio signal ρ: a density of air c: a sound speed (=340 m/s)

k: ω/c

This means that, if the sound pressure p(rj) of the point rj in the closed curved surface S and the particle speed un(rj) in the direction of the normal line n at the point rj can be appropriately controlled, the sound field of the internal space of the closed curved surface S can be reproduced.

Figure 3A:
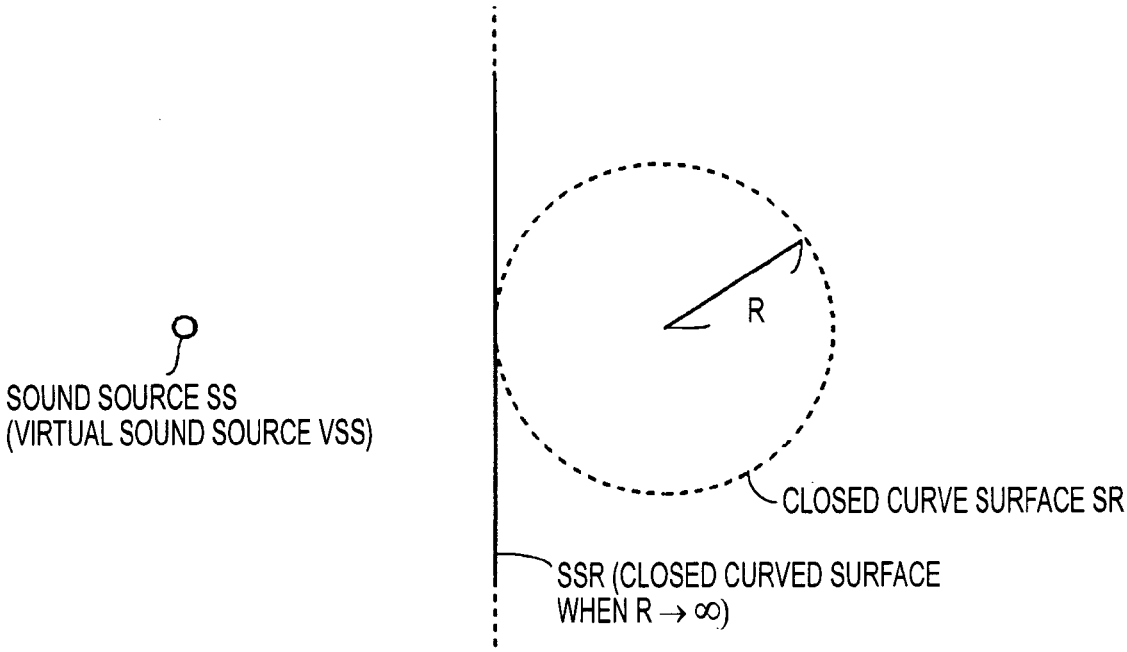
FIGS. 3A and 3B show sound spaces for the purpose of illustrating an embodiment of the present invention.

Therefore, as shown in, for example, FIG. 3A, it is assumed that a sound source SS is disposed on the left side and that a closed curved surface SR (indicated by the dashed line) of the radius R is disposed on the right side. Then, if the sound pressure and the particle speed in the closed curved surface SR are controlled as described above, the sound field that is created in the internal space of the closed curved surface SR by the sound source SS can be reproduced even if there is no sound source SS. Then, at this time, a virtual sound source VSS is created at the position of the sound source SS. That is, if the sound pressure and the particle speed in the closed curved surface SR are appropriately controlled, a listener inside the closed curved surface SR perceives the sound as if the virtual sound source VSS exists at the position of the sound source SS.

Next, if the radius R of the closed curved surface SR is made to be infinitely large, as indicated by the solid line in FIG. 3A, the closed curved surface SR becomes a plane SSR. Also, in this case, the sound field that is created in the internal space of the closed curved surface SR, that is, on the right side of the plane SSR, by the sound source SS can be reproduced even if there is no sound source SS by controlling the sound pressure and the particle speed in the plane SSR. Also, at this time, a virtual sound source VSS is created at the position of the sound source SS.

More specifically, if the sound pressures and the particle speeds at all the points in the plane SSR can be appropriately controlled, the virtual sound source VSS can be disposed to the more left side than the plane SSR, so that the sound field can be disposed on the right side and the sound field can be made to be a listening space.

Figure 3B:
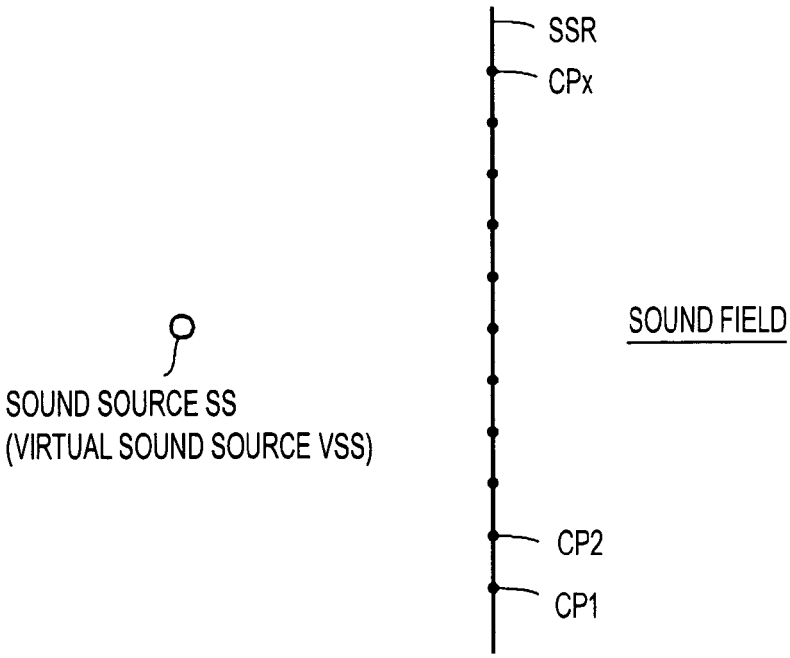

In practice, as is also shown in FIG. 3B, the plane SSR needs only to have a finite expansion, and the sound pressures and the particle speeds at the finite points CP1 to CPx in the plane SSR need only to be controlled. In the following, the points CP1 to CPx, at which the sound pressure and the particle speed are controlled, in the plane SSR will be called "control points".

Figure 4:
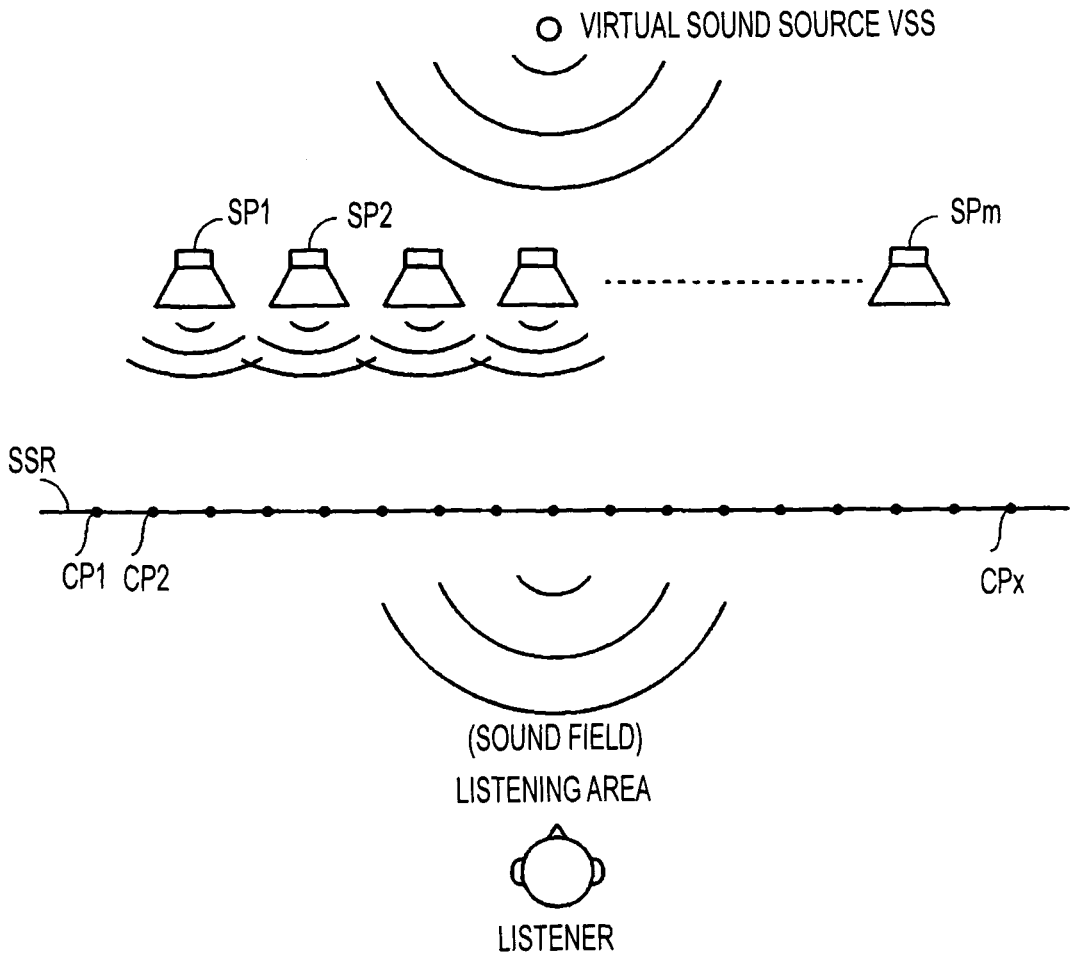
FIG. 4 shows an example of the sound space according to an embodiment of the present invention.

(2) Control of Sound Pressures and Particle Speeds at the Control Points CP1 to CPx In order to control the sound pressure and the particle speed at the control points CP1 to CPx, as is also shown in FIG. 4, the following need to be done:

(A) A plurality of m speakers SP1 to SPm are disposed, for example, in parallel with the plane SSR on the sound source side of the plane SSR. These speakers SP1 to SPm constitute a speaker array.

(B) An audio signal supplied to the speakers SP1 to SPm is controlled to control the sound pressure and the particle speed at the control points CP1 to CPx.

As a result of the above, the wavefronts of the sound waves output from the speakers SP1 to SPm are synthesized, effects are achieved as if sound waves are output from the virtual sound source VSS, and also, a desired sound field can be formed. Since the positions at which the wavefronts of the sound waves output from the speakers SP1 to SPm are synthesized become the plane SSR, in the following, the plane SSR will be called a "wavefront synthesized surface".

(3) State of the Wavefront Synthesis

Figure 5B:
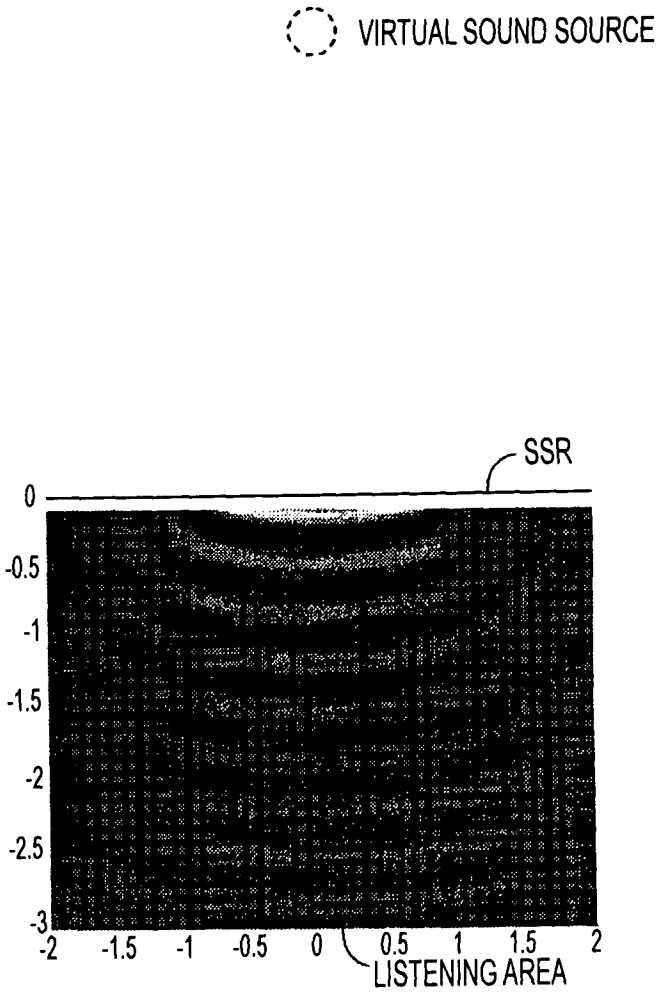
FIGS. 5A and 5B show states of wavefront synthesis in an embodiment of the present invention.
Figure 5A:
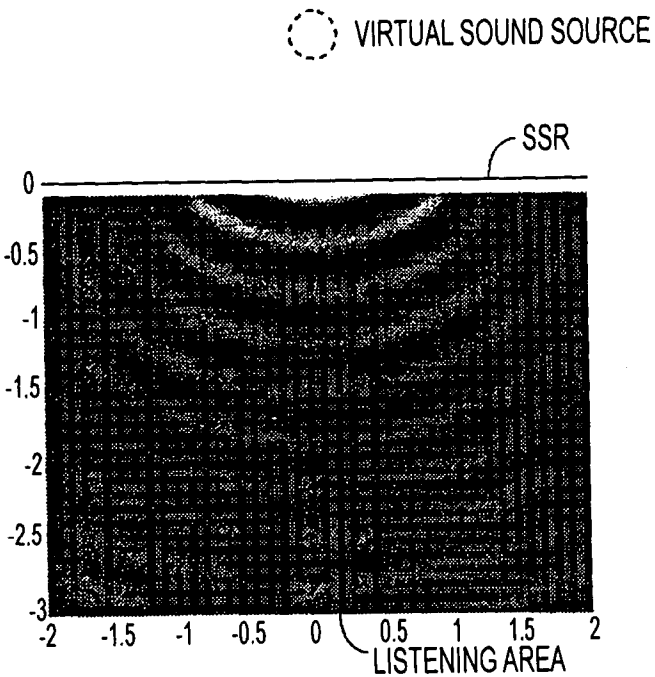

FIGS. 5A and 5B show examples of the state of wavefront synthesis by simulation. The content and the method of processing an audio signal supplied to the speakers SP1 to SPm will be described later. In this example, each value is set as described below:

The number m of speakers: 16

The spacing between speakers: 10 cm

The diameter of the speaker: 8 cm

The position of the control point: 10 cm from the speaker toward the listener

The number of control points: 116 in one row at the intervals of 1.3 cm

The position of the virtual sound source:

1 m in front of the listening area (in the case of FIG. 5A)

3 m in front of the listening area (in the case of FIG. 5B)

The expansion of the listening area: 2.9 m (in the front and back direction)×4 m (in the left and right direction).

If the following are set:

w: a spacing between speakers [m]

c: a sound speed (=340 m/s), and fhi: an upper-limit reproduction frequency [Hz], then fhi=c/(2w).

Therefore, it is preferable that the spacing w of the speakers SP1 to SPm (m=16) be narrower. For this purpose, it is necessary to decrease the diameter of the speakers SP1 to SPm.

When the audio signal supplied to the speakers SP1 to SPm is digitally processed, in order to eliminate the influence due to the sampling thereof, the spacing between the control points CP1 to CPx is preferably set to ¼ to ⅕ or less than the wavelength corresponding to the sampling frequency. In the example of the above-described numerical values, since the sampling frequency is set to 8 kHz, the spacing between the control points CP1 to CPx is set to 1.3 cm as described above.

Then, according to FIGS. 5A and 5B, the wavefronts of the sound waves output from the speakers SP1 to SPm are synthesized as if they are sound waves output from the virtual sound source VSS, and clear ripples are depicted in the listening area. That is, it can be seen that the wavefront synthesis is performed appropriately, and the target virtual sound source VSS and the target sound field are formed.

As described above, in the case of FIG. 5A, since the position of the virtual sound source VSS is 1 m to the front of the listening area and the virtual sound source VSS is comparatively close to the plane SSR, the curvature of the ripples is small. However, in the case of FIG. 5B, since the position of the virtual sound source VSS is 3 m to the front of the listening area and the virtual sound source VSS is further away from the plane SSR than that in the case of FIG. 5A, the curvature of the ripples is greater than that in FIG. 5A. That is, it can be seen that the further away the virtual sound source VSS is made, the closer to the parallel wavefronts the sound waves become.

(4) Algorithm of Wavefront Synthesis

For the wavefront synthesis in the wavefront synthesized surface SSR, for example, in FIG. 4, the signals output from the speakers SP1 to SPm need only to be controlled so that the difference between the signals that are generated at the control points CP1 to CPx by the sound source SS at the position of the virtual sound source VSS and the signals that are generated at the control points CP1 to CPx by the speakers SP1 to SPm becomes a minimum.

Figure 6A:
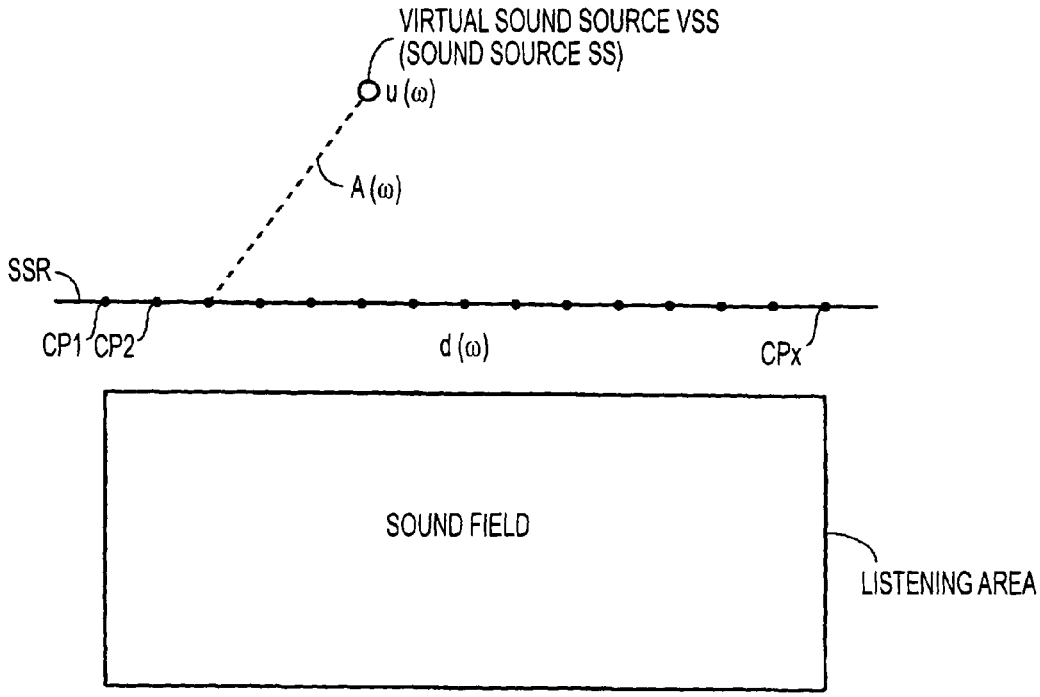
FIGS. 6A and 6B show sound spaces for the purpose of illustrating an embodiment of the present invention.

Therefore, as shown in FIG. 6A, if the following are set:

u(ω): an output signal of the virtual sound source VSS, that is, an original audio signal A(ω): a transfer function from the virtual sound source VSS to the control points CP1 to CPx d(ω): a signal to be obtained at the control points CP1 to CPx (desired signal), since the signal such that the transfer function A(ω) is superposed onto the original audio signal u(ω) is the desired signal d(ω), the following is obtained:

$$d(\omega)=A(\omega)\cdot u(\omega).$$

In this case, by determining in advance the transfer characteristics from the virtual sound source VSS to the control points CP1 to CPx, the transfer function A(ω) can be defined.

Figure 6B:
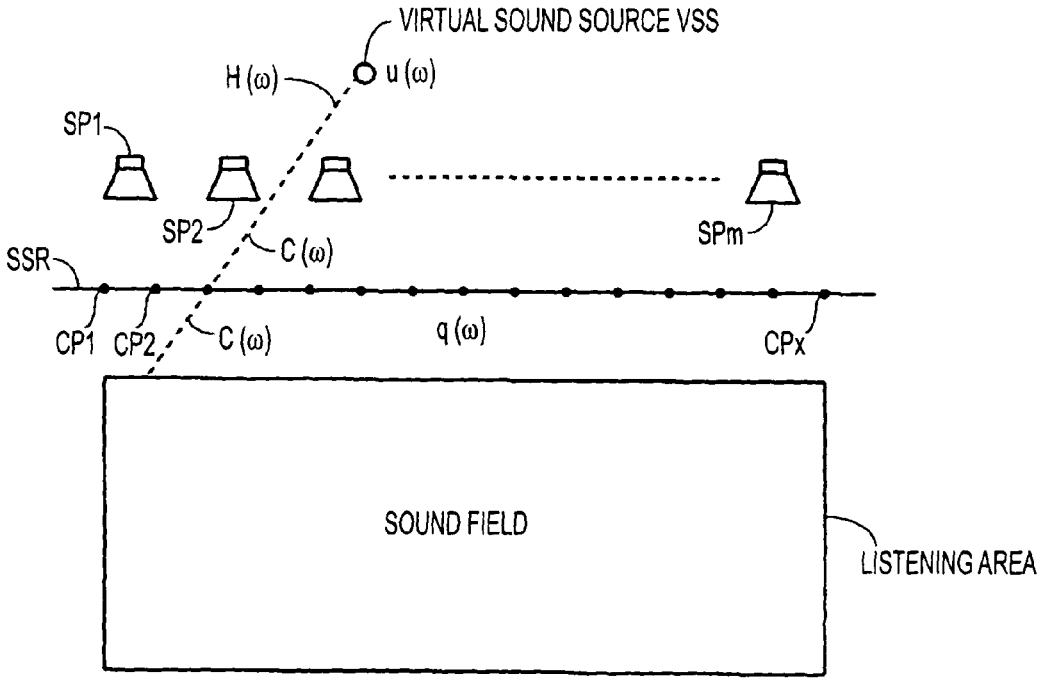

As shown in FIG. 6B, if the following are set:

H(ω): a transfer function to be superposed onto the signal u(ω) in order to realize appropriate wavefront synthesis C(ω): a transfer function from the speakers SP1 to SPm to the control points CP1 to CPm, and q(ω): a signal that is actually reproduced by the wavefront synthesis at the control points CP1 to CPx, similarly, the following is obtained:

$$q(\omega)=C(\omega)\cdot H(\omega)\cdot u(\omega).$$

In this case, by determining the transfer characteristics in advance from the speakers SP1 to SPm to the control points CP1 to CPx, the transfer function C(ω) can be defined.

If the transfer function H(ω) is controlled to make the reproduction signal q(ω) equalize the desired signal d(ω), appropriate wavefront synthesis is realized by the reproduction signal q(ω) at this time, and a sound field and a sound image equivalent to the sound field and the sound image formed by the desired signal d(ω) can be reproduced, respectively.

Therefore, it follows that an error signal e(ω) indicated by e(ω)=d(ω)−q(ω) is determined, and the transfer function H(ω) is controlled so that the value $e(\omega)^T\cdot e(\omega)$ becomes a minimum. The least square solution becomes $$H(\omega)=C(\omega)^T\cdot A(\omega)/(C(\omega)^T C(\omega)).$$

In order to make the virtual sound source VSS an ideal point sound source, the transfer function Q(ω) indicated by the following $$Q(\omega)=e(-j\omega x/c)/x,$$

where x is the distance, and c is the sound speed, is substituted in the transfer functions A(ω) and C(ω) in order to determine the transfer function H(ω).

(5) Generation Circuit

Figure 7:
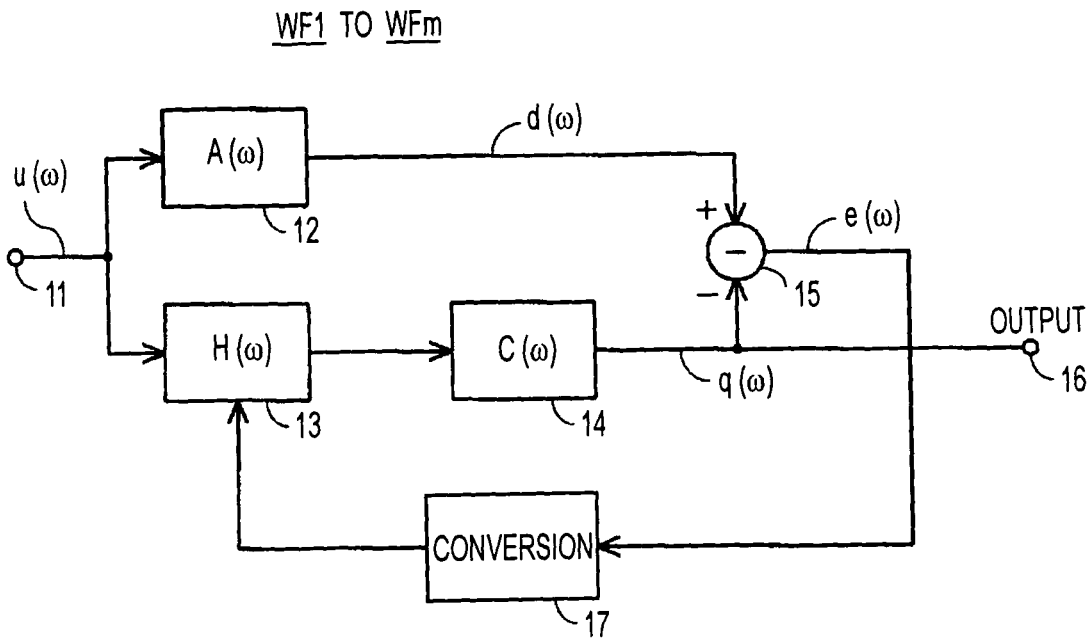
FIG. 7 is a system diagram showing one form of a circuit that can be used in an embodiment of the present invention.

When the reproduction audio signal q(ω) is to be generated from the original audio signal u(ω) in accordance with the above-described (4), the generation circuit can be constructed as shown in, for example, FIG. 7. The generation circuit is provided for each of the speakers SP1 to SPm, and these are denoted as generation circuits WF1 to WFm.

More specifically, in each of the generation circuits WF1 to WFm, the digitized original audio signal u(ω) is supplied to a digital filter 12 via an input terminal 11, whereby the signal is changed to a desired signal d(ω). Furthermore, the signal u(ω) is supplied to a digital filter 13 and a digital filter 14 in sequence, whereby the signal u(ω) is changed to a reproduction signal q(ω). Then, these signals d(ω) and q(ω) are supplied to a subtraction circuit 15, where an error signal e(ω) is extracted. This signal e(ω) is converted into a control signal by a conversion circuit 17, and the transfer function H(ω) of the digital filter 13 is controlled in accordance with the control signal so that the error signal e(ω) becomes a minimum.

Therefore, if the reproduction signal q(ω) output from the digital filter 14 is supplied to the corresponding speaker from among the speakers SP1 to SPm, the virtual sound source VSS is formed, and a sound image is formed at the position thereof.

(6) Embodiments

Figure 8:
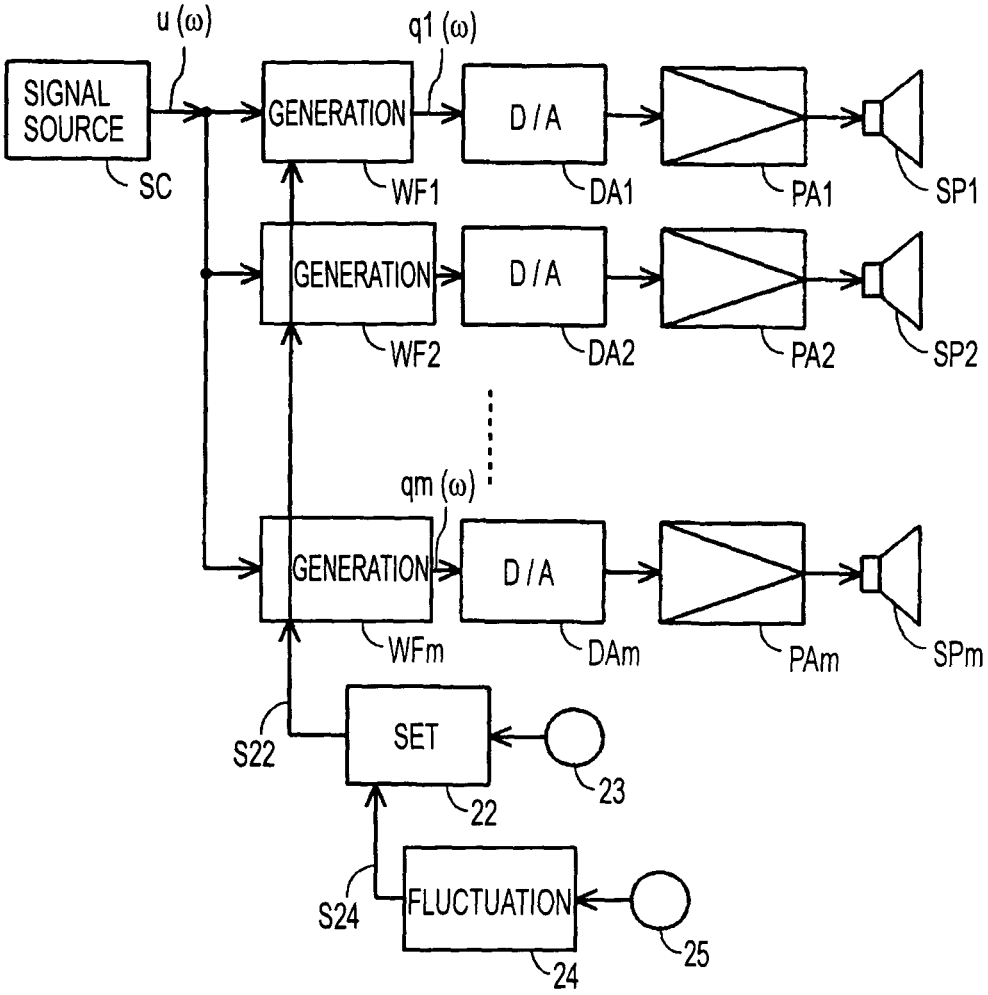
FIG. 8 is a system diagram showing an embodiment of the present invention.

FIG. 8 shows an example of a playback apparatus for causing the position of the virtual sound source VSS to fluctuate or for making the position of the virtual sound source VSS move in accordance with the above-described (1) to (5). That is, the digital audio signal u(ω) is extracted from the signal source SC, such as a CD player, a DVD player, and a digital broadcasting tuner. This signal u(ω) is supplied to the generation circuits WF1 to WFm, where reproduction signals q1(ω) to qm(ω) corresponding to the reproduction signal q(ω) are generated. Then, these signals q1(ω) to qm(ω) are supplied to D/A converter circuits DA1 to DAm, whereby the signals are D/A-converted into analog audio signals, and these signals are supplied to speakers SP1 to SPm via power amplifiers PA1 to PAm, respectively.

In this case, the speakers SP1 to SPm, as described with reference to, for example, FIG. 4, are arranged horizontally in front of the listener, and these speakers constitute a speaker array. More specifically, they can be set as described in (3).

In order to set the position of the virtual sound source VSS, a sound source position setting circuit 22 is provided, and a predetermined control signal S22 is formed. The control signal S22 is supplied to the digital filters 13 of the generation circuits WF1 to WFm, whereby transfer functions H1(ω) to Hm(ω) thereof are controlled. As a result, when an operation section 23 of the sound source position setting circuit 22 is operated, the transfer functions H1(ω) to Hm(ω) of the digital filters 13 of the generation circuits WF1 to WFm are controlled in accordance with the operation, and the position of the virtual sound source VSS is changed as shown in FIGS. 5A and 5B or is further changed to another position.

Furthermore, in order to cause the position of the virtual sound source VSS to fluctuate, a control circuit 24 is provided, and a fluctuation control signal S24 is generated. The sound source position setting circuit 22 is controlled in accordance with this control signal S24. As a result, the position of the virtual sound source VSS set in accordance with the control signal S22 is made to fluctuate.

Parameters for the prohibition/permission of the fluctuation, the type (waveform), the magnitude, the frequency (speed), the presence or absence of regularity, etc., are selected or set by a listener (user) through an operation section 25 connected to the fluctuation control circuit 24. At this time, the higher the frequency, the smaller the amplitude can be made, like 1/f fluctuation.

Figure 9A:
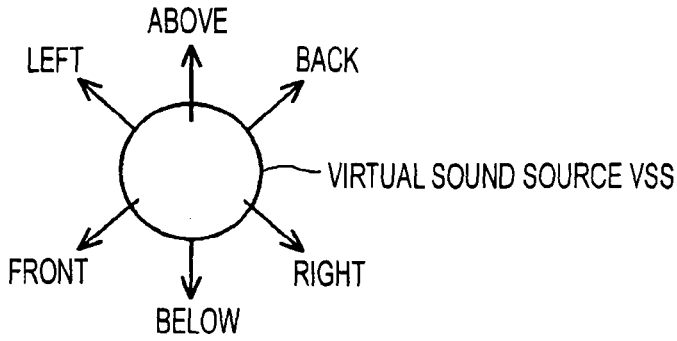
FIGS. 9A 9B, 9C, and 9D illustrate an embodiment of the present invention.
Figure 9B:
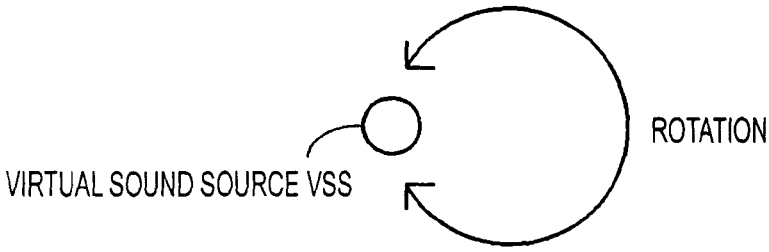
Figure 9C:
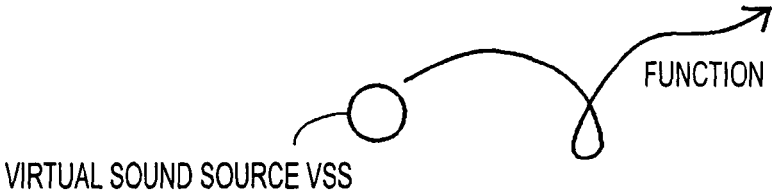

FIGS. 9A, 9B, 9C, and 9D show examples of fluctuation obtained under the control of the control signal S24. FIG. 9A shows a case in which the virtual sound source VSS fluctuates in the front and back direction, in the left and right direction, in the up and down direction, or in the direction in which the above is combined. FIG. 9B shows a case in which the virtual sound source VSS rotates within a predetermined plane in a three-dimensional space. FIG. 9C shows a case in which the virtual sound source VSS moves in a three-dimensional manner along a course indicated by a function provided in advance.

Figure 9D:
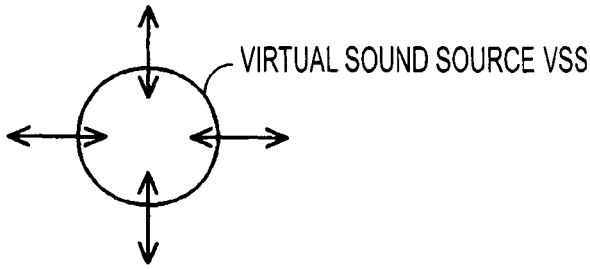
Figure 10:
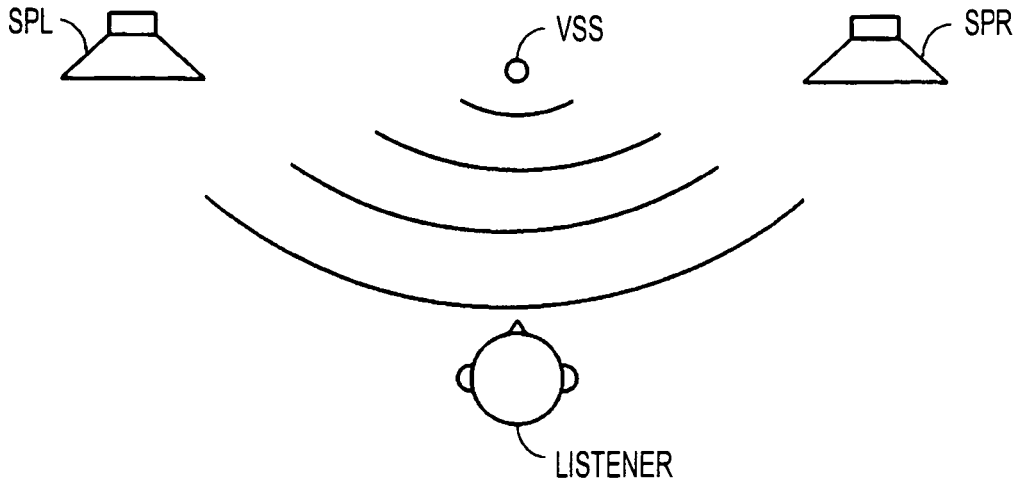
FIG. 10 illustrates a typical stereo sound field.

FIG. 9D shows a case in which the magnitude of the virtual sound source VSS changes. In this case, for example, the speakers SP1 to SPm need to be divided into a plurality of sets, so that the position of the virtual sound source formed by each set is made to differ, and also, the combination is changed. That is, if the virtual sound sources are formed at substantially the same position, a small virtual sound source is formed as a whole. Conversely, if the virtual sound sources are formed at different positions, a large virtual sound source is formed as a whole. The fluctuations of FIGS. 9A to 9D can also be combined, so that control can be performed in such a way that the magnitude of the virtual sound source VSS is changed as shown in FIG. 9D while, for example, rotating as shown in FIG. 9B. The patterns of these fluctuations are selected or set by the listener (user) via the operation section 25.

In this manner, in the playback apparatus shown in FIG. 8, the position of the virtual sound source VSS that is reproduced can be made to fluctuate or can be changed. Therefore, according to this playback apparatus, during the playback of music, it is possible to provide a sound field and a sound source that are natural, that have an abundant lively feeling and a rich sense of realism, and that are expansionary. Alternatively, in the case of voice, it is possible to produce reality by which breathing can be sensed.

Furthermore, the movement state of the sound source can also be simulated, and special deformation effects can also be created. In particular, when video such as animation, a game, or an SF movie exists, a more effective sound image processing can be performed. For example, when the sound source comes closer to the listener from a distant position, if the position of the virtual sound source VSS is controlled in such a manner and at the same time, control is performed so that the magnitude of the virtual sound source VSS gradually increases as the sound source approaches, more powerfulness and a sense of more realism can be given.

(7) Others

In the above description, a case is described in which a plurality of m speakers SP1 to SPm are arranged horizontally in one row in order to configure a speaker array. Alternatively, the speakers SP1 to SPm may also be configured by arranging them in a matrix over a plurality of rows×a plurality of columns within the vertical plane. In the above description, the speakers SP1 to SPm and the plane SSR are made parallel to one another. However, they do not need to be parallel, and the speakers SP1 to SPm may not be arranged in a straight-line shape or in a plane shape.

For the sense of hearing with respect to the direction, the sensitivity and the identification performance are high with respect to the horizontal direction, but are low with respect to the vertical direction. Therefore, the speakers SP1 to SPm may be arranged in a cross shape or in the shape of an inverted letter T. Furthermore, when the speakers SP1 to SPm are to be integrated with an AV system, the speakers SP1 to SPm can also be arranged in the shape of a frame so as to be above, below, left, and right to the display, or in the shape of a symbol Π so as to be above, left, and right to the display, or in the shape of a symbol Π so as to be below, left, and right to the display.

Furthermore, when video exists, the fluctuation of the virtual sound source VSS can also be controlled in accordance with a video signal that becomes the video.

It should be understood by those skilled in the art that various modifications, combinations, sub-combinations and alterations may occur depending on design requirements and other factors insofar as they are within the scope of the appended claims or the equivalents thereof.

What is claimed is:

1. A method of an information processing apparatus for reproducing audio signals, the method comprising:

supplying a predetermined audio signal to a speaker array to synthesize surface wavefronts and forming a virtual sound source by the wavefront synthesis;

controlling, by the information processing apparatus, the predetermined audio signal to position the virtual sound source at a first position; and generating, by the information processing apparatus, a fluctuation control signal based on one of a plurality of predetermined three-dimensional patterns set by a user that defines a plurality of directions of movement to automatically move an effective position of the virtual sound source in a three-dimensional manner and in a continuous movement from the first position to a plurality of positions located in a vicinity of the first position.

2. The method of reproducing audio signals according to claim 1, wherein the fluctuation control signal is generated in order to automatically rotate within a predetermined plane in a three-dimensional space the effective position in the continuous movement from the first position to the plurality of positions located around the center point.

3. The method of reproducing audio signals according to claim 1, wherein the fluctuation control signal is based on data associated with the predetermined audio signal.

4. The method of reproducing audio signals according to claim 1, wherein the fluctuation control signal is generated in order to continuously fluctuate the effective position of the virtual sound source.

5. The method of reproducing audio signals according to claim 1, wherein the fluctuation control signal is generated in order to automatically move the effective position of the virtual sound source in the continuous movement from the first position to the plurality of positions located in front or back of the first position.

6. The method of reproducing audio signals according to claim 1, wherein the fluctuation control signal is generated in order to automatically rotate the effective position of the virtual sound source in the continuous movement from the first position to the plurality of positions located around the center point.

7. The method of reproducing audio signals according to claim 1, wherein the controlling includes controlling the predetermined audio signal to position the virtual sound source at a second position, and the generating includes generating fluctuation control signals to automatically move the effective position of the virtual sound source in a three-dimensional manner and in a continuous movement from the second position to a plurality of positions located in a vicinity of the second position.

8. An apparatus for reproducing audio signals, comprising:

a processing circuit to process an audio signal supplied to a speaker array so that wavefronts of sound waves output from the speaker array are synthesized to form a virtual sound source;

a setting circuit to set a first position of the virtual sound source; and a control circuit to generate a fluctuation control signal based on one of a plurality of predetermined three-dimensional patterns set by a user that defines a plurality of directions of movement so that an effective position of the virtual sound source, which is set by the setting circuit, is automatically moved in a three-dimensional manner and in a continuous movement from the first position to a plurality of positions located in a vicinity of the first position.

9. The apparatus for reproducing audio signals according to claim 8, further comprising:

an interface configured to receive a user input setting, a magnitude and a frequency of the plurality of directions of movement defined in the three dimensional pattern.

10. The apparatus for reproducing audio signals according to claim 8, wherein the fluctuation control signal is generated so that the effective position is automatically rotated within a predetermined plane in a three-dimensional space in the continuous movement from the first position to the plurality of positions located around the center point.

11. The apparatus for reproducing audio signals according to claim 8, wherein the fluctuation control signal is based on data associated with the predetermined audio signal.

12. The apparatus for reproducing audio signals according to claim 8, wherein the fluctuation control signal is generated in order to continuously fluctuate the effective position of the virtual sound source.

* * * * *